United States Patent [19]

Depoorter et al.

[11] 3,933,506

[45] Jan. 20, 1976

[54] SPECTRAL SENSITIZATION OF DIRECT-POSITIVE SILVER HALIDE EMULSIONS

[75] Inventors: Henri Depoorter, Mortsel; Jozef Remy Schellekens, Wilsele, both of Belgium

[73] Assignee: AGFA-GEVAERT N.V., Mortsel, Belgium

[22] Filed: Apr. 29, 1974

[21] Appl. No.: 465,369

[30] Foreign Application Priority Data

May 18, 1973 United Kingdom ..... 23863/73

[52] U.S. Cl. ..... 96/101; 96/108; 96/130

[51] Int. Cl.[2] ..... G03C 1/36

[58] Field of Search ..... 96/101, 130, 131, 108

[56] References Cited

UNITED STATES PATENTS

| | | | |
|---|---|---|---|
| 3,492,123 | 1/1970 | Mee et al. | 96/101 |
| 3,615,610 | 10/1971 | Florens et al. | 96/101 |
| 3,816,121 | 6/1974 | Shiba et al. | 96/101 |

*Primary Examiner*—J. Travis Brown
*Attorney, Agent, or Firm*—A. W. Breiner

[57] ABSTRACT

Novel dyes are described for sepctrally sensitizing direct-positive silver halide emulsions comprising fogged silver halide grains. The dyes correspond to the formula:

wherein:

$R_1$ is hydrogen, an alkyl group, an aryl group, or an acyl group, each of $R_2$ and $R_3$ represents hydrogen, carboxyl, sulpho, nitro, cyano, halogen, an alkyl group or an aryl group, each of $L_1$ and $L_2$ represents a methine group, *m* is 1 or 2, Y is O, S, Se or $R_4$ represents an aliphatic group or an aromatic group, $X^-$ represents an anion but does not exist when the molecule itself contains an anionic group, and Z represents the atoms necessary to close a fused-on benzoor naphtho-ring carrying one or more substituents at least one of which is a $COR_5$ or $SO_2R_6$ group wherein $R_5$ is alkyl, aryl, hydroxyl, O-alkyl, $NH_2$, NH-alkyl, NH-aryl, and $R_6$ is alkyl, aryl, $NH_2$, NH-alkyl, NH-aryl,

4 Claims, No Drawings

SPECTRAL SENSITIZATION OF DIRECT-POSITIVE SILVER HALIDE EMULSIONS

The present invention relates to novel methine dyes and to direct-positive silver halide emulsions spectrally sensitized by means of these dyes.

It is known that direct-positive images can be obtained with certain types of photographic silver halide emulsions without previously forming a negative image. For this purpose, the silver halide grains are fogged by an overall-exposure to actinic radiation or by an overall chemical fogging e.g. by means of reducing agents, before or after they are coated on a support. Upon image-wise exposure of the pre-fogged emulsions the development centres formed by said fogging are destroyed at the exposed areas and remain at the unexposed areas. By subsequent conventional development by means of silver halide developers a direct-positive image is formed.

For the spectral sensitization of negative type silver halide emulsions there is a wide choice of spectrally sensitizing dyes such as mono- and trimethine cyanines, rhodacyanines, hemicyanines, merocyanines, styryl dyes, oxonol dyes, etc. Most of these dyes, however, are unsuitable for the spectral sensitization of direct-positive emulsions.

The choice of really suitable sensitizing dyes for direct-positive emulsions is rather poor and therefore, novel spectrally sensitizing dyes for direct-positive emulsions are still needed and sought after.

In British Pat. No. 1,186,720 dimethine dyes have been described for use in direct-positive silver halide emulsions in which the methine chain links a carbazole nucleus to another nitrogen-containing heterocycle, which is preferably a so-called desensitizing nucleus e.g. nuclei containing nitro-substituents.

In accordance with the present invention, novel methine dyes containing a carbazole nucleus are provided as spectral sensitizers for direct-positive silver halide emulsions. These dyes do not contain a desensitizing nucleus as defined in the said British Patent and are superior over the related dyes of the said British Patent in that they yield higher photographic speeds and/or better differentiation between maximum and minimum density.

The dyes according to the present invention can be represented by the formula I:

I.

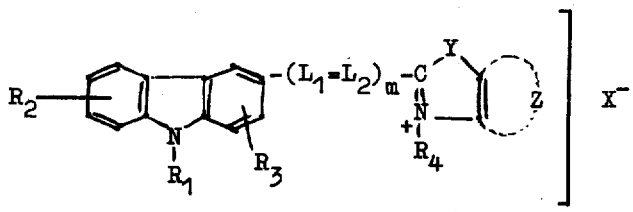

wherein:

$R_1$ is hydrogen, alkyl including substituted alkyl e.g. methyl, ethyl, propyl, butyl, sulphoalkyl, e.g. sulphopropyl, sulphatoalkyl, e.g. sulphatopropyl, cyanoalkyl e.g. cyanoethyl and carboxyalkyl e.g. carboxyethyl, an aryl group including a substituted aryl group e.g. phenyl, sulphophenyl, carboxyphenyl and tolyl, or an acyl group e.g. acetyl, benzoyl, methylsulphonyl and phenylsulphonyl, each of $R_2$ and $R_3$ represents hydrogen, carboxyl, sulpho, nitro, cyano, halogen, alkyl including substituted alkyl e.g. methyl and ethyl, aryl including substituted aryl e.g. phenyl, tolyl, chlorophenyl, methoxyphenyl, nitrophenyl, each of $L_1$ and $L_2$ represents a methine group or substituted methine group,

*m* represents 1 or 2,

Y represents O, S, Se or

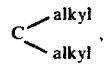

$R_4$ represents a substituent of the type contained in cyanine dyes on the cyanine nitrogen atom, for example an aliphatic group including a saturated aliphatic group, an unsaturated aliphatic group and a cycloaliphatic group e.g. alkyl, aralkyl, allyl, and cycloalkyl or an aromatic group which groups may carry substituents, more particularly an alkyl group such as methyl, ethyl, propyl, isopropyl, butyl or isobutyl, a substituted alkyl group such as β-hydroxyethyl, β-acetoxyethyl, carboxymethyl, carboxyethyl, sulphoethyl, sulphopropyl, sulphobutyl, sulphatopropyl, sulphatobutyl, phosphonoethyl, phosphonopropyl, phosphonobutyl, the group —A—CO—O—B—$SO_2$—OH wherein A and B have the same significance as set forth in British Pat. No. 886,271 such as sulphocarbomethoxymethyl, ω-sulphocarbopropoxymethyl, ω-sulphocarbobutyoxymethyl, and p-(ω-sulphocarbobutoxy)-benzyl, the group —A—W—N-H—V—B as described in British Pat. No. 904,332 wherein each of W and V represents carbonyl, sulphonyl or a single bond, at least one of W and B being sulphonyl, A represents an alkylene group e.g. a $C_1C_4$ alkylene group and B represents hydrogen, alkyl, substituted alkyl, amino, substituted amino e.g. acylamino, diethylamino with the proviso however that B does not represent hydrogen when V stands for carbonyl or sulphonyl, the group AWNHVB being examplified by N-(methylsulphonyl)carbamylmethyl, γ-(acetylsulphamyl)-propyl, and δ-(acetylsulphamyl)-butyl, an aralkyl group such as a benzyl, a substituted aralkyl group such as carboxybenzyl and sulphobenzyl, a cycloalkyl group such as cyclohexyl, an allyl group, an aryl group such as phenyl and a substituted aryl group such as carboxyphenyl, $X^-$ stands for an anion of the type contained in cyanine dye salts such as halide, perchlorate, methyl sulphate, benzene sulphonate, p-toluene sulphonate, etc. but does not exist when the molecule itself contains an anionic group in which case the dye is a betaine dye salt, and Z represents the atoms necessary to close a fused-on benzo or naphtho-ring carrying one or more substituents at least one of which is the group —$COR_5$ wherein $R_5$ is OH, O—alkyl, $NH_2$, NH-alkyl,
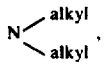
NH-aryl,
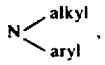
alkyl or aryl, or $SO_2R_6$, wherein $R_6$is alkyl, aryl, $NH_2$, NH-alkyl, $N(alkyl)_2$ N-arylalkyl, NH-Aryl.
Representative examples of dyes corresponding to the above general formula are:
| | | Abs. max. nm | Extinction coefficient $\varepsilon \times 10^{-5}$ |
|---|---|---|---|
| 1. | 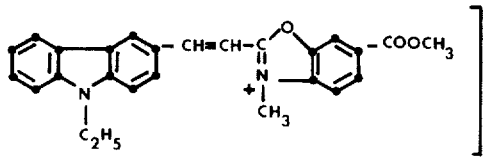 | 473 | 0.27 |
| 2. | 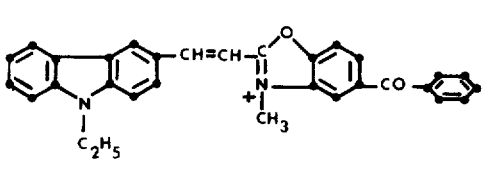 | 471 | 0.35 |
| 3. | 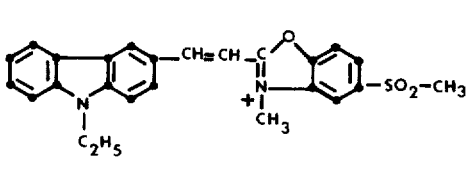 | 476 | 0.28 |
| 4. | 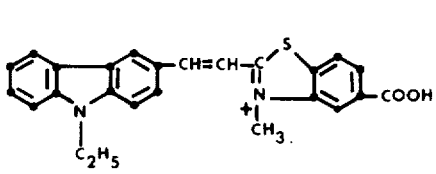 | 481 | 0.42 |
| 5. | 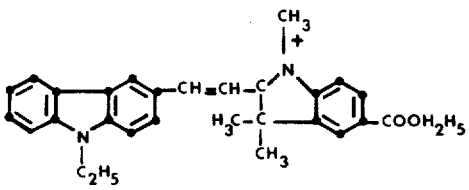 | 520 | 0.52 |

-continued
| | | Abs. max. nm | Extinction coefficient $\epsilon \times 10^{-5}$ |
|---|---|---|---|
| 6. | 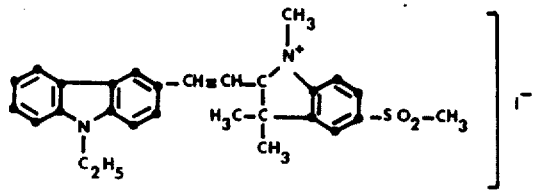 | 519 | 0.55 |
| 7. | 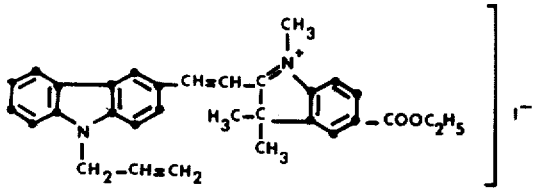 | 519 | 0.55 |
| 8. | 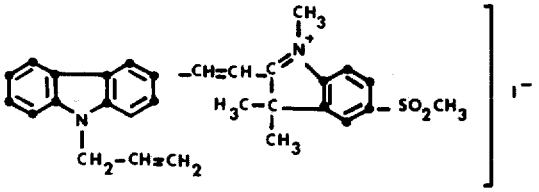 | 522 | 0.52 |
| 9. | 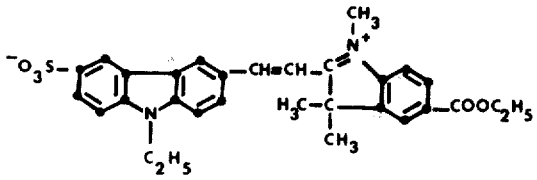 | 506 | 0.32 |
| 10. | 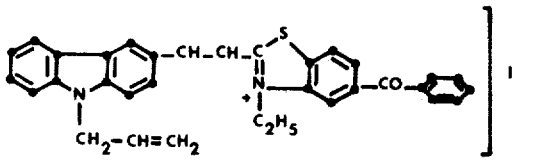 | 475 | 0.24 |
| 11. | 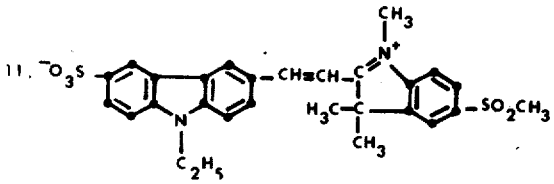 | 536 | 0.23 |
| 12. | 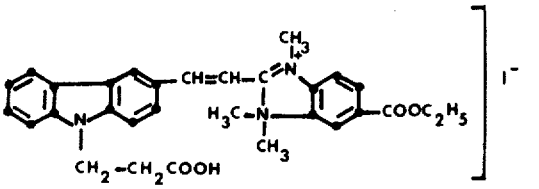 | 516 | 0.49 |
| 13. | 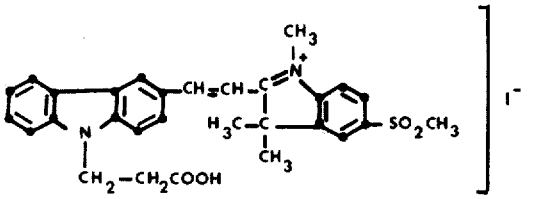 | 523 | 0.49 |

The dyes according to the present invention can be prepared according to methods well known in the art of methine dye synthesis.

They may be prepared, for example, by condensing a compound of the following formula II:

II.

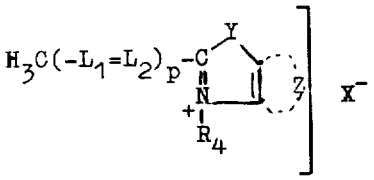

wherein:

$L_1$, $L_2$, $R_4$, Y, Z and X have one of the meanings given above, and $p$ is 0 or 1, with a compound of the following formula III:

III.

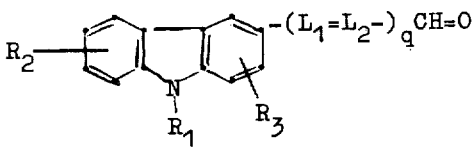

wherein:

$R_1$, $R_2$, $R_3$, $L_1$ and $L_2$ have one of the meanings given above, and $q$ is 0 or 1 but is 0 when $p$ is 1.

These condensations can be carried out by heating in the presence of an acid anhydride such as acetic anhydride. The reaction can also be carried out in an inert diluent such as methanol, ethanol, ethylene glycol monomethyl ether, acetonitrile, dimethylsulphoxide, tetrahydrothiophene-1,1-dioxide or dimethylformamide, in the presence of a basic condensing agent.

The intermediates of formula II are known substances and methods for preparing them are known to the art.

The intermediates of formule III with $q = 0$ can be prepared from the corresponding carbazole compound by a Vilsmeier and Haack reaction with dimethylformamide as formylating agent.

The intermediates of formula III with $q = 1$ can be prepared analogously using N-methylanilinopropene(1)-al(3) instead of dimethylformamide.

Examples of carbazole compounds and methods for preparing them can be found in Chapter II of "Heterocyclic compounds with Indole and Carbazole systems," by W. C. Sumpter and F. M. Miller, Interscience Publishers, Inc., New York, 1954.

The following preparations illustrate how the dyes can be prepared.

Preparation 1: dye 1

2,3-dimethyl-6-methoxycarbonylbenzoxazolium iodide (3.33 g; 0.01 mole) was dissolved in hot tetrahydro thiophene dioxide (50 ml). 3-formyl-N-ethyl carbazole (2.23 g; 0.01 mole) in acetic anhydride (30 ml) was added and the mixture was heated for 10 min on an oil bath at 150°C. After cooling, the dye formed was sucked off, washed with aceton and ethanol and recrystallized from a mixture of ethanol and dimethylformamide.

Yield: 3.0 g. Melting point: above 260°C. I %: calc. 23.6. found 23.2

Preparation 2: dye 2

A mixture of 2,3-dimethyl-5-benzoyl-benzoxazolium iodide (3.79 g; 0.01 mole), 3-formyl-N-ethylcarbazole (2.23 g; 0.01 mole) and acetic anhydride (60 ml) was refluxed for 15 minutes. The dye, which crystallised on cooling, was recrystallized from a mixture of isopropanol and dimethylformamide.

Yield: 1.7 g. Melting point: 260°C (with decomposition). I %: calc. 21.7. found 21.5.

Preparation 3: dye 4

2,3-dimethyl-5-carboxybenzothiazolium iodide (1.67 g; 0.005 mole), 3-formyl-N-ethylcarbazole (1.12 g; 0.005 mole), ethanol (20 ml) and piperidine (0.5 ml) were refluxed for 1 h. After cooling the dye formed was collected with suction, washed with ethanol and recrystallized from a mixture of phenolethanol.

Yield: 1.2 g. Melting point: above 260°C. COOH: calc. 1.85 meq/g. found 1.88 meq/g.

The other dyes are prepared analogously.

The methods of incorporating the dyes in the emulsions are relatively simple and well known to those skilled in the art of emulsion making.

The dyes according to the present invention are usually added to the direct-positive silver halide emulsion in the form of a solution in a suitable solvent, e.g. water, lower alcohols such as methanol and ethanol, ketones such as acetone, amines such as triethylamine, pyridine, mixtures of these solvents and other well known solvents known in the art. The dyes may be used in widely varying concentrations. They are generally used in amounts varying from about 50 mg to about 2 g per mole of silver halide. The optimum concentration is dependent on the particular dye concerned and the particular emulsion used and can be determined readily by methods known to those skilled in the art.

The direct-positive silver halide emulsions can be prepared according to known methods. The silver halide composition may consist of any of the known silver halides suitable for the formation of direct-positive silver halide emulsions e.g. silver bromide, silver chloride, silver chlorobromide, silver bromoiodide and silver chlorobromoiodide. Emulsion blends can also be used e.g. blends of silver chloride and silver chlorobromide. The silver halide preferably comprises at most 20 mole % of silver iodide which may be located mainly towards the surface of the grains as described in German Patent Application P 22 60 117.8.

Especially suitable for use according to the present invention are direct-positive silver halide emulsions the silver halide grains of which have an average grain-size of less than about 1 micron. The silver halide grains can be regular and have one of the commonly known shapes e.g. cubic, octahedral, and even rhombohedral. They may have a substantially uniform diameter frequency distribution e.g. 95% by weight of the silver halide grains can have a diameter which is within about 40%, preferably within about 30% of the mean grain diameter.

The silver halide grains of the direct-positive silver halide emulsions of the present invention are fogged according to methods well known in the art. They may be fogged e.g. by an overall exposure to actinic radiation or by reduction sensitization e.g. by high pH and/or low pAg silver halide precipitating or digestion conditions e.g. as described by Wood, J. Phot. Sci. 1 (1953) 163, or by treatment with reducing agents. Fogging may also occur by reduction sensitization in the presence of a compound of a metal more electropositive than silver.

Reducing agents suitable for use include hydrazine, hydroxylamine, tin(II) compounds e.g. tin(II) chloride, tin complexes and tin chelates of the (poly)amino(poly)carboxylic acid type as described in United Kingdom Pat. No. 1,209,050, ascorbic acid, formaldehyde, thiourea dioxide, polyamines such as diethylene triamine, phosphonium salts such as tetra(hydroxymethyl)phosphonium chloride, bis(p-aminoethyl)sulphide and its water-soluble salts, etc. Preferred reducing agents are thiourea dioxide and tin(II) chloride.

The compounds of a metal more electropositive than silver include gold compounds e.g. gold(III)chloride, potassium chloroaurate, potassium chloroaurite, and potassium aurithiocyanate, as well as compounds of rhodium, platinum, iridium and palladium, e.g. ammonium hexachloropalladate and potassium chloroiridate. Preferred noble metal compounds are gold compounds.

When fogging of the silver halide grains occurs by means of a reducing agent e.g. thiourea dioxide and a compound of a metal more electropositive than silver especially a gold compound, the reducing agent is preferably used initially and the gold compound subsequently. However, the reverse order can be used or both compounds can be used simultaneously.

The degree of fogging of the direct-positive emulsions used according to the invention may vary within a wide range. This degree of fogging depends, as is known in the art, on the concentration of the fogging agents used as well as on the pH, the pAg, the temperature and the duration of the fogging treatment.

As is known in the art, high photographic speeds can be obtained at low degrees of fogging. Thus, the direct-positive silver halide emulsions of the invention can be fogged, as is described in U.S. Pat. No. 3,501,307, to such a degree that a test-portion of the silver halide emulsion, comprising the fogged silver halide grains and a compound accepting electrons, when coated on a support to give a maximum density of at least about one upon processing for 6 minutes at about 20°C in a developer of the composition given below, has a maximum density which is at least about 30% greater than the maximum density of an identical test portion processed for 6 minutes at about 20°C in the same developer after being bleached for about 10 minutes at about 20°C in a bleach of the composition given below:

| | |
|---|---|
| bleach: | |
| potassium cyanide | 50 mg |
| glacial acetic acid | 3.47 ml |
| sodium acetate | 11.49 g |
| potassium bromide | 119 mg |
| water to make | 1 liter |
| developer: | |
| N-methyl-p-aminophenol sulphate | 2.5 g |
| sodium sulphite | 30.0 g |
| hydroquinone | 2.5 g |
| sodium metaborate | 10.0 g |
| potassium bromide | 0.5 g |
| water to make | 1 liter |

In order to further enhance the photographic speed, the silver halide grains of the direct-positive silver halide grains of the present invention may be fogged even to a degree where strictly speeking no fogging as defined in the said U.S. Pat. No. 3,501,307 is observed, e.g. as described in co-pending United Kingdom Pat. Application No. 7742/72. According to this co-pending application the silver halide grains are fogged to such an extent that a test portion of the emulsion ready for coating, when coated on a support at a coverage of 0.50 g to 5.50 g of silver per sq.m gives a density of less than 0.50 upon processing without exposure for 6 min. at 20°C in the above developer and an identical test portion thereof when coated in an identical way gives a density of at least twice the value of the density of the first test portion and a density of at least 0.50 upon processing without exposure for 3 minutes at 20°C in a developer of the following composition:

| | |
|---|---|
| hydroquinone | 15 g |
| 1-phenyl-3-pyrazolidinone | 1 g |
| trisodium salt of ethylene diamine tetraacetic acid | 1 g |
| anhydrous sodium carbonate | 30 g |
| anhydrous sodium sulphite | 70 g |
| 40 % aqueous sodium hydroxide | 16 ml |
| water to make | 1 liter (pH : 11): |

When the silver halide grains have been fogged too heavily it is also possible to treat the fogged silver halide grains with a bleaching agent in order to obtain optimum sensitivity.

In view of the foregoing, the terms "fogged" and "fogging" as used herein are employed in a very broad sense so that the very low degrees of fogging as defined in the above co-pending United Kingdom Patent Application are also embraced which means that fogging is effected to such extent that a test portion of the emulsion when coated as described above gives a density of at least 0.50 upon processing for 3 min. at 20°C in the above latter developer composition.

When the silver halide grains are fogged to a very low degree it is advantageous to develop the exposed direct-positive silver halide emulsions substantially in the absence of halide ions as described in United Kingdom Pat. Application 7743/72.

The speed and stability of the direct-positive silver halide emulsions according to the present invention can also be enhanced by increasing the pAg of the emulsion just before coating, preferably after addition of the spectral sensitizer. Favourable photographic speeds are obtained when the pAg is adjusted, before coating, to a value corresponding to an E.M.F. of + 30 mV or lower (silver against saturated calomel electrode). It is also favourable to further enhance the speed to lower the pH of the emulsion just before coating for example of a pH of at least about 5 as described in United Kingdom Pat. Application 32889/72.

In the formation of the direct-positive silver halide emulsions used according to the present invention various colloids can be used as vehicles or binding agents for the silver halide. They include any of the hydrophilic colloids generally employed in the photographic field for example gelatin. However, the gelatin may be replaced wholly or partly by other natural hydrophilic colloids, e.g. albumin, zein, agar-agar, gum arabic, alginic acid, and derivatives thereof, such as esters, amides and salts thereof etc., or synthetic hydrophilic resins; e.g. polyvinyl alcohol and poly-N-vinyl pyrrolidone, acrylamide polymers, cellulose ethers, partially hydrolyzed cellulose acetate and the like.

In addition to the hydrophilic binding agents other synthetic binding agents can be employed in the emulsion e.g. homo- and copolymers of acrylic or methacrylic acid or derivatives thereof such as esters, amides and nitriles and vinyl polymers for example vinyl esters and vinyl ethers.

The direct-positive photographic silver halide emulsions can be coated on a wide variety of supports which include opaque supports e.g. paper and metal supports as well as transparent supports e.g. glass, cellulose nitrate film, cellulose acetate film, cellulose aceto-butyrate film, polyvinyl acetal film, polystyrene film, polyethylene terephthalate film, polycarbonate film, and other polyester film. It is also possible to employ paper coated with $\alpha$-olefin polymers e.g. paper coated with polyethylene, polypropylene, ethylene-butylene copolymers and the like.

The direct-positive emulsions sensitized with dyes according to the present invention may further contain dyes of the type which in silver halide emulsions of the negative type act as desensitizers and therefore are called desensitizing dyes. Particularly suitable for this purpose are the nitrobenzylidene and nitrostyryl dyes described in U.S. Pat. No. 3,615,610. The emulsions may also comprise desensitizing dihydropyrimidine compounds of the type described in U.S. Pat. application Ser. No. 269,861 (= published German Patent Application 2,237,036) as well as other desensitizing compounds e.g. 2,3,5-triphenyl-2H-tetrazolium chloride, 2-(4-iodophenyl)-3-(4-nitrophenyl)-5-phenyl tetrazolium chloride, 1-methyl-8-nitroquinolinium methyl sulphate, 1-m-nitrobenzyl-quinolinium chloride, 1-m-nitrobenzylpyridinium chloride, 1-p-nitro-benzylisoquinolinium chloride, 1-p-nitrobenzylbenzo[f-]quinolinium chloride and 1-methyl-2-m-nitrostyrylquinolinium methyl sulphate.

The silver halide emulsion may further contain any of the ingredients generally employed in silver halide emulsions. They may comprise speed increasing agents of the polyalkylene oxide type e.g. polyethylene glycols and derivatives thereof, quaternary ammonium and phosphonium compounds as well as ternary sulphonium compounds, thioether compounds, etc. The emulsions can comprise the common emulsion stabilizing agents, e.g. mercury compounds which include homopolar or salt-like compounds of mercury and aromatic or heterocyclic compounds such as mercaptotriazoles, simple mercury salts, sulphonium mercury double salts, etc. They may comprise azaindene emulsion stabilizers for example tetra- or pentaazaindenes especially those comprising hydroxyl or amino groups as described in Birr, Z. Wiss. Phot. 47 (1962) 2–58. Other suitable emulsion stabilizers are heterocyclic mercapto compounds e.g. 1-phenyl-5-mercaptotetrazole, quaternary benzthiazolium derivatives, benztriazole and the like.

The emulsions may further contain colour forming couplers. Among the useful colour forming couplers are the monomeric and polymeric colour couplers e.g. pyrazolone colour couplers as well as phenolic, heterocyclic and open chain colour couplers having a reactive methylene group.

Particularly suitable are colour couplers showing a low halogen accepting character which can be determined by the test described by R. P. Held in Phot. Sci. Eng. Vol. 11, (1967) p. 406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through "halogen acceptance" by the colour coupler. Colour couplers that do not delay or do not substantially delay the potential rise are particularly suitable for use in the direct-positive silver halide emulsions of the invention.

The colour couplers can be incorporated into the direct-positive photographic silver halide emulsion according to any suitable technique known to those skilled in the art for incorporating colour couplers in silver halide emulsions. For example, water-soluble colour couplers, e.g. those containing one or more sulpho or carboxyl groups (in acid or salt form), can be incorporated from an aqueous solution, if necessary, in the presence of alkali, and the water-insoluble or insufficiently water-soluble colour couplers from a solution in the appropriate water-miscible or water-immiscible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary, the low-boiling solvent is removed afterwards by evaporation.

The silver halide emulsion layer and any other hydrophilic colloid layer, which may be present in a direct-positive photographic material employed in accordance with the present invention, may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides, vinylsulphones, etc.

The direct-positive photographic silver halide elements may further contain antistatic agents, wetting agents as coating aids, e.g. saponin and synthetic surface-active compounds, plasticizers, matting agents, e.g. starch, silica, polymethyl methacrylate, zinc oxide, titanium dioxide, etc., optical brightening agents including stilbene, triazine, oxazole, and coumarin brightening agents, light-absorbing materials and filter dyes, mordanting agents, for anionic compounds, etc.

The following examples illustrate the present invention.

EXAMPLE 1

A washed silver iodobromide emulsion containing per kg 60 g of silver halide (95 mole % of silver bromide and 5 mole % of silver iodide) and chemically fogged with sodium hydroxide (pH = 12) during the precipitation step and subsequent heat-treatment (15 min. at 55°C and 10 min. at 80°C) was divided into several aliquot portions. To each of these portions one of the sensitizing dyes listed in the table below was added in an amount of 100 mg per 50 g of silver nitrate used to prepare the emulsion. Then the emulsions were coated on a cellulose triacetate support and dried. The materials were exposed in a sensitometer to white light and then developed in a common hydroquinone/p-N-methylaminophenol hemisulphate mixture and fixed. The total speed as well as the sensitization maxima obtained with the dyes of the invention are listed in the table below. The total speed is expressed in % with respect to the speed of an emulsion comprising no sensitizing dye to which a value 100 is given.

Table

| Sensitizing dye added | Total speed | Sensit.maximum nm |
|---|---|---|
| none | 100 | — |
| dyestuff 1 | 280 | 545 |
| dyestuff 2 | 200 | 550 |
| comparison dyes with formula: | | |
| 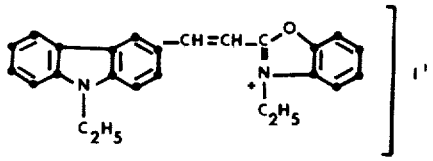 | 100 | 520 (very low maximum) |
| 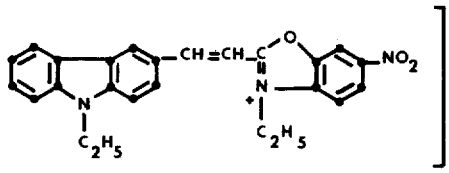 $H_3C-C_6H_4-SO_3^-$ | 140 | 560 (hardly a maximum) |
| dyestuff 5 | 560 | 600 |
| comparison dyes with formula | | |
| 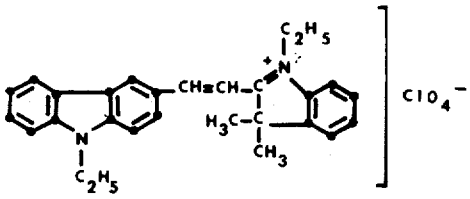 | 140 | 560 (very low max.) |
| 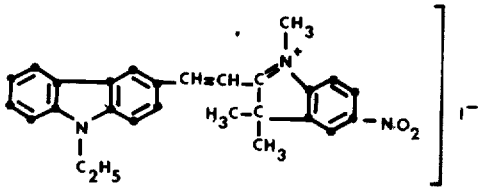 | 35 | — |

The above results show that the results obtained with the dyes according to British Pat. No. 1,186,720 even those with desensitizing nuclei, are inferior than those obtained with the dyes of the present invention.

EXAMPLE 2

A monodisperse, cubic direct-positive photographic silver bromoiodide emulsion (2.5 mole % of iodide) having an average grain size of about 0.2 micron, was prepared under controlled pH, pAg, and temperature conditions during precipitation of the silver halide. The pH was maintained at about 5.5, the pAg at 8.2 and the temperature at 45°C. After adjustment of the pAg to 10, the emulsion was chill-set, shredded, and washed with cold water.

The emulsion was reduction- and gold-fogged by adjustment of the pAg to 5.3 and the pH to 7, by heating for 90 min. at 60°C and by the addition of 30 mg of chloroaurate per mole of silver halide. Heating was continued for 80 minutes at 60°C whereupon the pAg was adjusted to 8.2 at 35°C.

The emulsion was divided into several aliquot samples of 100 g comprising 0.15 mole of silver halide. To each sample 87.5 mg of Pinacryptol yellow and 87.5 mg of one of the dyes referred to hereinbefore were added. Then the emulsion samples were coated on a subbed support and dried.

The direct-positive elements obtained were exposed in a spectrograph and developed in a conventional developer. Direct-positive spectrograms were obtained. The total speed as well as spectral sensitization maxima are listed in the following table. The total speed is expressed in percent with respect to the speed of an emulsion comprising no sensitizing dye to which a value 100 is given.

| Sensitizing dye added | Sens.max. nm | Total speed |
|---|---|---|
| none | — | 100 |
| dyestuff 1 | 540 | 280 |
| dyestuff 2 | 520 | 560 |
| dyestuff 3 | 540 | 280 |
| dyestuff 5 | 550 | 1100 |
| dyestuff 6 | 540 | 560 |
| dyestuff 7 | 580 | 2200 |
| dyestuff 8 | 570 | 1600 |
| dyestuff 9 | 560 | 2200 |
| dyestuff 10 | 550 | 560 |
| dyestuff 11 | 570 | 1100 |
| dyestuff 12 | 580 | 2200 |
| dyestuff 13 | 580 | 800 |

We claim:

1. A direct-positive photographic element comprising a support and a light-sensitive silver halide emulsion layer containing fogged silver halide grains wherein the said emulsion layer contains a dye of the formula:

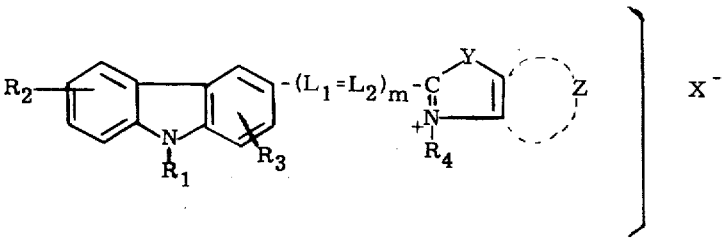

wherein:

$R_1$ is hydrogen, an alkyl group, an aryl group or an acyl group, each of $R_2$ and $R_3$ represents hydrogen, carboxyl, sulpho, nitro, cyano, halogen, an alkyl group, or an aryl group.

each of $L_1$ and $L_2$ represents a methine group,

*m* is 1 or 2,

Y is O, S, Se or

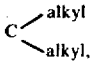

$R_4$ represents an aliphatic group, or an aromatic group, $X^-$ represents an anion but does not exist when the molecule itself contains an anionic group, and Z represents the atoms necessary to close a fused-on benzo- or naphtho-ring having a $COR_5$ or $SO_2R_6$ group wherein $R_5$ is alkyl, aryl, hydroxyl, O-alkyl, $NH_2$, NH-alkyl, NH-aryl,

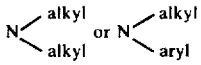

and $R_6$ is alkyl, aryl, $NH_2$, NH-alkyl, NH-aryl,

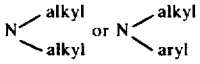

and does not include a desensitizing group.

2. A direct-positive photographic element according to claim 1, wherein the emulsion layer also comprises a nitrobenzylidene or nitrostyryl dye.

3. A direct-positive photographic element according to claim 1, wherein the silver halide grains are fogged by reduction sensitization.

4. A direct-positive photographic element according to claim 3, wherein the silver halide grains are fogged by reduction sensitization and a compound of a metal more electropositive than silver.

* * * * *